United States Patent [19]

Tanner et al.

[11] 4,135,924

[45] Jan. 23, 1979

[54] FILAMENTS OF ZIRCONIUM-COPPER GLASSY ALLOYS CONTAINING TRANSITION METAL ELEMENTS

[75] Inventors: Lee E. Tanner, Summit; Ranjan Ray, Morristown, both of N.J.

[73] Assignee: Allied Chemical Corporation, Morris Township, Morris County, N.J.

[21] Appl. No.: 823,055

[22] Filed: Aug. 9, 1977

[51] Int. Cl.[2] ..... C22C 9/00; C22C 16/00; C22C 30/02

[52] U.S. Cl. ..... 75/159; 75/134 C; 75/153; 75/177

[58] Field of Search ..... 75/177, 153, 159, 170, 75/122, 134 C

[56] References Cited

U.S. PATENT DOCUMENTS

| | | | |
|---|---|---|---|
| 3,856,513 | 12/1974 | Chen et al. | 75/170 |
| 3,863,700 | 2/1975 | Bedell et al. | 164/87 |
| 3,871,836 | 3/1975 | Polk et al. | 75/122 |
| 3,881,540 | 5/1975 | Kavish | 164/87 |
| 3,960,200 | 6/1976 | Kavish | 164/281 |
| 4,036,638 | 7/1977 | Ray et al. | 75/123 B |

OTHER PUBLICATIONS

Szofran et al., "Spin Fluctuations and Spin-Spin Interactions in Amorphous Metallic Alloys," Magnitism & Magnetic Materials, AIP Conference Proceedings No. 18, c.p. pp. 282-286 (1974).

Szofran et al., "Electronic and Magnetic Properties of Amorphous and Crystalline $Zr_{40}Cu_{60-x}Fe_x$ alloy," Physical Review B, vol. 14, pp. 2160-2170, Sep. 1976.

Rapidly Quenched Metals, Grant et al., (MIT)-Second International Conference, pp. 351-358 (1976).

Pond, Jr. et al. "A Method of Producing Rapidly Solidified Filamentary Castings" Nansaime, vol. 245, pp. 2475-2476, 1969.

*Primary Examiner*—Arthur J. Steiner

*Attorney, Agent, or Firm*—Ernest D. Buff; Gerhard H. Fuchs

[57] ABSTRACT

Continuous filaments of zirconium-copper glassy alloys containing at least one of the transition metal elements of iron, cobalt and nickel are disclosed. The filaments are substantially totally glassy and have a composition consisting essentially of about 1 to 68 atom percent copper plus at least one element selected from the group consisting of about 1 to 29 atom percent iron, about 1 to 43 atom percent cobalt and about 1 to 42 atom percent nickel, balance essentially zirconium plus incidental impurities. The glassy alloy filaments of the invention evidence unusually high electrical resistivities of over 200 $\mu\Omega$-cm.

3 Claims, 3 Drawing Figures

FILAMENTS OF ZIRCONIUM-COPPER GLASSY ALLOYS CONTAINING TRANSITION METAL ELEMENTS

BACKGROUND OF THE INVENTION

1. Field of the Invention

This invention relates to glassy alloys, and, in particular, to filaments of zirconium-copper glassy alloys containing transition metal elements.

2. Description of the Prior Art

Material having high electrical resistivity (over 200 μΩ-cm) and negative or zero temperature coefficients of resistivity are required for precision resistors, resistance thermometers and the like. High resistivity materials permit fabrication of smaller resistors. Negative temperature coefficients of resistivity provide larger resistance vaues at lower temperatures, thus increasing the sensitivity of low temperature resistance thermometers. Zero temperature coefficients of resistivity provide stability of resistance with temperature, which is required for useful precision resistors. Commonly available alloys such as Constantan (49 μΩ-cm) and Nichrome (100 μΩ-cm) are examples of materials generally employed in these applications.

A number of splat-quenched foils of binary alloys of zirconium and titanium with transition metal elements such as nickel, copper, cobalt and iron have been disclosed elsewhere; see, e.g. Vol. 4, *Metallurgical Transactions,* pp. 1785–1790 (1973) (binary Zr-Ni alloys); *Izvestia Akadameya Nauk SSSR, Metals,* pp. 173–178 (1973) (binary Ti or Zr alloys with Fe, Ni or Cu); and Vol. 2, *Scripta Metallurgica,* pages 357–359 (1968) (binary Zr-Ni, Zr-Cu, Zr-Co and Ti-Cu alloys).

A number of splat-quenched foils of ternary alloys of zirconium, copper and iron have been disclosed as well; see, e.g. *Rapidly Quenched Metals,* N. J. Grant and B. C. Giessen, Eds., pp. 351–358, Massachusetts Institute of Technology (1976) and Vol. 14, *Physical Review B,* pp. 2160–2170 (1976).

While splat-quenched foils are useful for measurement of properties thereon, they are totally unsuited for use in commercial applications, which typically require homogeneous, ductile materials. Splats, as is well-known, tend to be inhomogeneous, of non-uniform thickness, composition and width and of varying degree of glassiness across the splat.

SUMMARY OF THE INVENTION

In accordance with the invention, continuous filaments of zirconium-copper glassy alloys containing transition metal elements are provided. The alloy filaments are substantially glassy and have a composition consisting essentially of about 1 to 68 atom percent copper plus at least one element selected from the group consisting of about 1 to 29 atom percent iron, about 1 to 43 atom percent cobalt and about 1 to 42 atom percent nickel, balance essentially zirconium plus incidental impurities.

The glassy alloy filaments of the invention possess useful electrical properties with resistivities of over 200 μΩ-cm, moderate densities and moderately high crystallization temperature and hardness values.

DETAILED DESCRIPTION OF THE INVENTION

Figure 1:
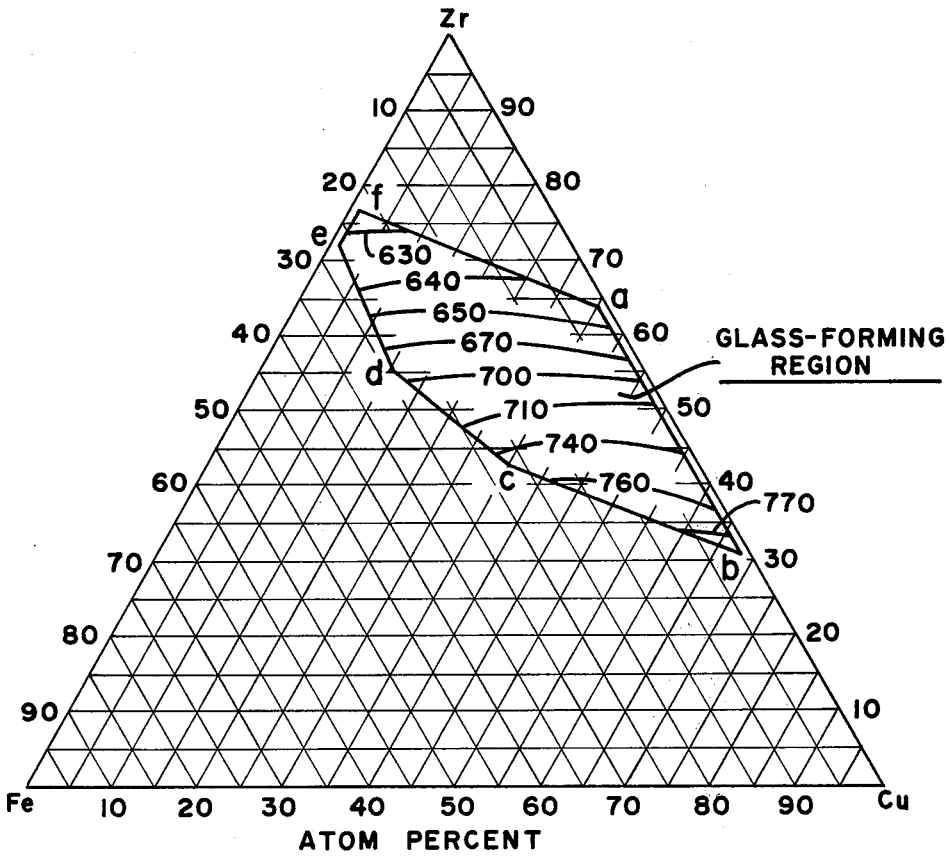
FIG. 1, on coordinates of atom percent, depicts the preferred glass-forming region in the zirconium-copper-iron system, and additionally includes a contour plot of the glass transition temperatures of the system.

Substantially continuous filaments of the glassy alloys of the invention find use in a number of applications, especially including electrical applications, because of their uniquely high electrical resistivities of over 200 μΩ-cm and negative or zero temperature coefficients of resistivity. These high electrical resistivities render the filaments particularly suitable for use in various applications such as elements for resistance thermometers, precision resistors and the like.

In the crystalline state, the filaments of the invention would be of little utility since the compositions employed herein when formed in the crystalline state are observed to be hard, brittle and almost invariably multiphase, and cannot be formed or shaped. Consequently, these compositions cannot be rolled, forged, etc. to form filaments. In contrast, the filaments of the invention, as prepared by well-known rapid quenching techniques, are substantially homogeneous, single phase and ductile and evidence uniform thickness, width, composition, and degree of glassiness.

The term "filament" as used herein includes any slender body whose transverse dimensions are much smaller than its length, examples of which include ribbon, wire, strip, sheet and the like of regular or irregular cross-section.

The alloy filaments of the invention are substantially totally glassy and have a composition consisting essentially of about 1 to 68 atom percent copper plus at least one element selected from the group consisting of about 1 to 29 atom percent iron, about 1 to 43 atom percent cobalt and about 1 to 42 atom percent nickel, balance essentially zirconium plus incidental impurities.

In weight percent, the composition ranges of the alloys of the invention may be expressed as follows:

| | | | | | |
|---|---|---|---|---|---|
| Cu: | 0.8–60 | Cu: | 0.8–60 | Cu: | 0.8–60 |
| Fe: | 18–0.7 | Co: | 33–0.7 | Ni: | 32–0.7 |
| Zr: | bal. | Zr: | bal. | Zr: | bal. |

The purity of the compositions is that commonly found in normal commercial practice. However, addition of minor amounts of other elements that do not appreciably alter the basic character of the alloys may also be made.

The term "glassy", as used herein, means the state of matter in which the component atoms are arranged in a disorderly array, that is, there is no long-range order. Such a glassy material gives rise to broad, diffuse diffraction peaks when subjected to electromagnetic radiation in the X-ray region (about 0.01 to 50 Å wavelength). This is in contrast to crystalline material, in which the component atoms are arranged in an orderly array, giving rise to sharp diffraction peaks. Filaments of substantially totally glassy material are quite ductile and may be bent back 180° without breaking.

The thermal stability of the glassy alloy composition is an important property in certain applications. Thermal stability is characterized by the time-temperature transformation behavior of an alloy and may be determined in part by DTA (differential thermal analysis). Glassy alloys with similar crystallization temperature as observed by DTA may exhibit different embrittlement behavior upon exposure to the same heat treatment cycle. By DTA measurement, crystallization temperatures $T_c$ can be accurately determined by heating a glassy alloy (at about 20° to 50° C./min) and noting whether excess heat is evolved over a limited temperature range (crystallization temperature) or whether excess heat is absorbed over a particular range (glass transition temperature). In general, the glass transition temperature is near the lowest or first crystallization temperature $T_{c1}$ and, as is conventional, is the temperature at which the viscosity ranges from about $10^{13}$ to $10^{14}$ poise.

Filaments of the invention are formed by cooling a melt of the desired composition at a rate of at least about $10^{5}$° C./sec. A variety of techniques are available, as is well known in the art, for fabricating rapidly quenched substantially continuous filaments. Typically, a particular composition is selected, powders or granules of the requisite elements in the desired proportions are melted and homogenized and the molten alloy is rapidly quenched to form a filament on a chill surface, such as a rapidly rotating cylinder. Due to the highly reactive nature of these compositions, it is preferred that the filaments be fabricated in an inert atmosphere or in a partial vacuum.

Preferred compositions of filaments of the invention are as follows:

Zirconium-Copper-Iron System

Glass-forming compositions of the invention in the zirconium-copper-iron system consist essentially of about 1 to 68 atom percent (about 0.8–60 wt%) copper, about 29 to 1 atom percent (about 18–0.7 wt%) iron and the balance essentially zirconium plus incidental impurities. Substantially totally glassy compositions are obtained in the region shown in FIG. 1 bounded by the polygon a-b-c-d-e-f-a having at its corners the points defined by:

(a) 64 Zr - 35 Cu - 1 Fe
(b) 31 Zr - 68 Cu - 1 Fe
(c) 43 Zr - 35 Cu - 22 Fe
(d) 55 Zr - 16 Cu - 29 Fe
(e) 72 Zr - 1 Cu - 27 Fe
(f) 77 Zr - 1 Cu - 22 Fe.

Also depicted in FIG. 1 is a contour plot of constant glass transition temperature (in ° K.). It can be seen that the glass transition temperature increases with decreasing amount of zirconium. A contour plot of constant hardness shows similar behavior, that is, the hardness increases with decreasing zirconium composition. The hardness increases from just under 450 kg/mm$^2$ at point "f" to just over 650 kg/mm$^2$ at point "b".

Zirconium-Copper-Cobalt System

Figure 2:
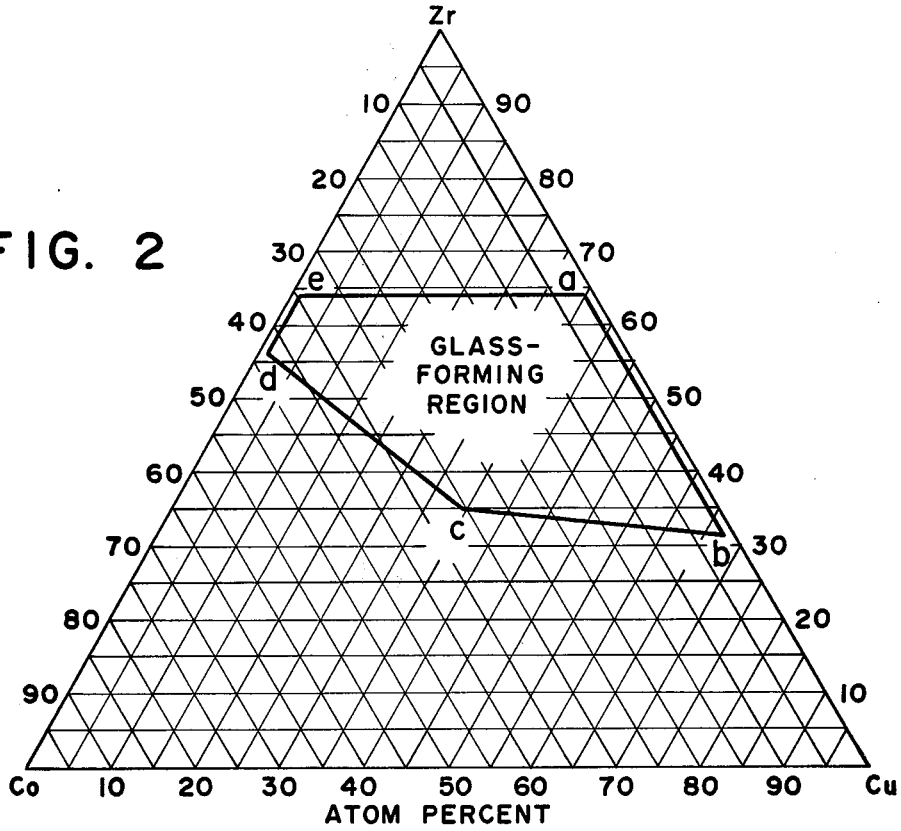
FIG. 2, on coordinates of atom percent, depicts the preferred glass-forming region in the zirconium-copper-cobalt system.

Glass-forming compositions of the invention in the zirconium-copper-cobalt system consist essentially of about 1 to 68 atom percent (about 0.8–60 wt%) copper, about 43 to 1 atom percent (about 33–0.7 wt%) cobalt and the balance essentially zirconium plus incidental impurities. Substantially glassy compositions are obtained in the region shown in FIG. 2 bounded by the polygon a-b-c-d-e-a having at its corners the points defined by (a) 64 Zr - 35 Cu - 1 Co
(b) 31 Zr - 68 Cu - 1 Co
(c) 35 Zr - 35 Cu - 30 Co
(d) 56 Zr - 1 Cu - 43 Co
(e) 64 Zr - 1 Cu - 35 Co.

Zirconium-Copper-Nickel System

Glass-forming compositions of the invention in the zirconium-coppernickel system consist essentially of about 1 to 68 atom percent (about 0.8–60 wt%) copper, about 42 to 1 atom percent (about 32–0.7 wt%) nickel and the balance essentially zirconium plus incidental impurities. Substantially glassy compositions are obtained in the region shown in FIG. 3 bounded by the polygon a-b-c-d-e-a having at its corners the points defined by (a) 64 Zr - 35 Cu - 1 Ni
(b) 31 Zr - 68 Cu - 1 Ni
(c) 40 Zr - 28 Cu - 32 Ni
(d) 57 Zr - 1 Cu - 42 Ni
(e) 71 Zr - 1 Cu - 28 Ni.

Figure 3:
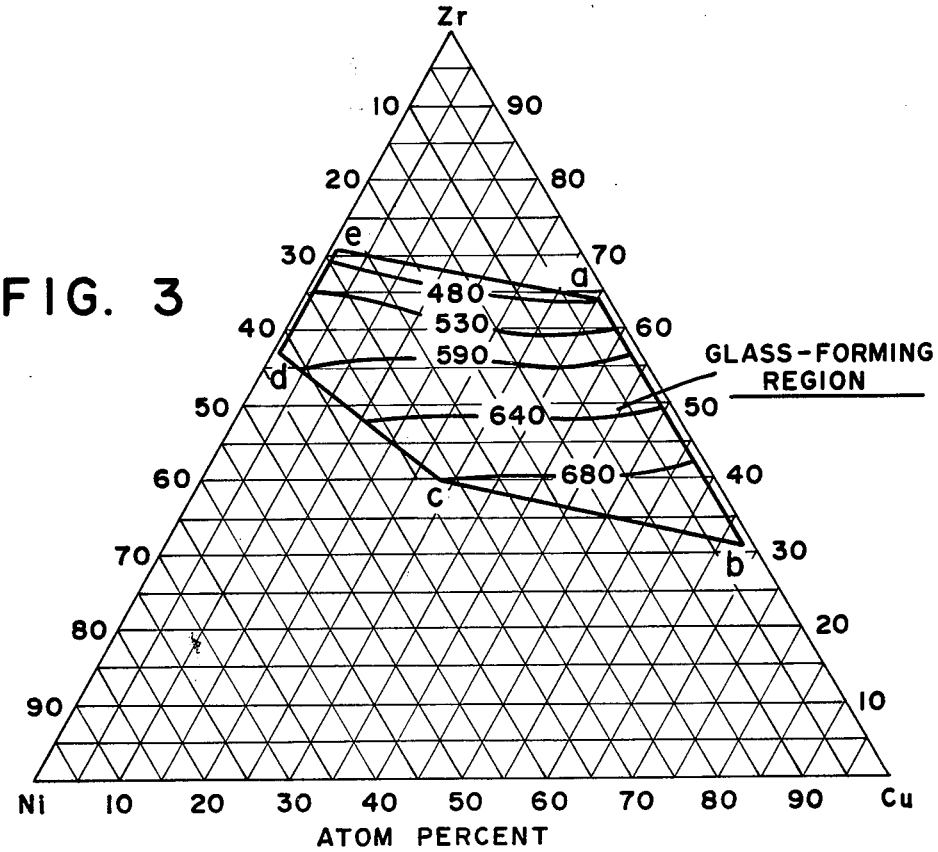
FIG. 3, on coordinates of atom percent, depicts the preferred glass-forming region in the zirconium-copper-nickel system, and additionally includes a contour plot of the hardness values of the system.

Also depicted in FIG. 3 is a contour plot of constant hardness values in kg/mm$^2$ (accurate to within about ± 5%). It can be seen that hardness increases with decreasing amount of zirconium. A contour plot of constant crystallization temperatures shows similar behavior, that is, the crystallization temperature increases with decreasing zirconium content. The glass transition temperature increases from just under 650° K. at point "e" to just over 760° K. at point "b". Similarly, a contour plot of constant density shows an increasing density with decreasing zirconium content. The density increases from just under 7.1 g/cm$^3$ at point "e" to just over 7.7 g/cm$^3$ at point "b".

EXAMPLES

Example 1

Continuous ribbons of several compositions of the glassy metal alloys of the invention were fabricated in vacuum employing quartz crucibles and extruding molten material onto a rapidly rotating copper chill wheel (surface speed about 3000 to 6000 ft/min) by over-pressure of argon. A partial pressure of about 200 μm of Hg was employed. A cooling rate of at least about $10^{5}$° C./sec was obtained. The degree of glassiness was determined by X-ray diffraction. From this, the limits of the glass-forming region in each system were established.

In addition, a number of physical properties of specific compositions were measured. Hardness was measured by the diamond pyramid technique, using a Vickers-type indenter consisting of a diamond in the form of a square-base pyramid with an included angle of 136° between opposite faces. Loads of 100 g were applied. Crystallization temperature was measured by differential thermal analysis at a scan rate of about 20° C./min. Electrical resistivity was measured at room temperature by a conventional four-probe method.

The following values of hardness in kg/mm$^2$, density in g/cm$^3$, crystallization temperature in ° K. and electrical resistivity in μΩ-cm, listed in Table I below, were measured for a number of compositions of filaments within the scope of the invention.

TABLE I

| Composition (atom perent) | Hardness (kg/mm²) | Density (g/cm³) | Crystal-lization Temperature (° K) | Electrical Resistivity (μΩ-cm) |
|---|---|---|---|---|
| $Zr_{60}Cu_{25}Fe_{15}$ | 521 | 7.09 | 700 | 255 |
| $Zr_{50}Cu_{35}Co_{15}$ | 610 | 7.39 | 737 | 270 |
| $Zr_{55}Cu_{30}Ni_{15}$ | 590 | 7.27 | 720 | 262 |

Example 2

Continuous ribbons of several compositions of glassy alloys in the zirconium-copper-iron system were fabricated as in Example 1. Hardness values in kg/mm² (50 g load) and density in g/cm³ are listed in Table II below.

TABLE II

| Composition (Atom percent) | | | Hardness (kg/mm²) | Density (g/cm³) |
|---|---|---|---|---|
| Zr | Cu | Fe | | |
| 80 | 15 | 5 | 546 | 6.77 |
| 75 | 20 | 5 | 407 | 6.76 |
| 65 | 30 | 5 | 445 | 7.02 |
| 60 | 35 | 5 | 572 | 7.21 |
| 55 | 40 | 5 | 524 | 7.19 |
| 50 | 45 | 5 | 540 | 7.35 |
| 45 | 50 | 5 | 627 | 7.45 |
| 40 | 55 | 5 | 652 | 7.58 |
| 35 | 60 | 5 | 633 | 7.93 |
| 30 | 65 | 5 | 695 | 7.81 |
| 80 | 10 | 10 | 494 | 6.79 |
| 70 | 20 | 10 | 451; 473 | 6.92; 6.89 |
| 65 | 25 | 10 | 458 | 7.00 |
| 60 | 30 | 10 | 478 | 7.09 |
| 55 | 35 | 10 | 557 | 7.19 |
| 50 | 40 | 10 | 540 | 7.31 |
| 45 | 45 | 10 | 670 | 7.43 |
| 40 | 50 | 10 | 616 | 7.51 |
| 35 | 55 | 10 | 673 | 7.68 |
| 75 | 10 | 15 | 451 | 6.81 |
| 70 | 15 | 15 | 447 | 6.89 |
| 55 | 30 | 15 | 540 | 7.15 |
| 50 | 35 | 15 | 630 | 7.28 |
| 45 | 40 | 15 | 666 | 7.38 |
| 75 | 5 | 20 | 418 | 6.79 |
| 70 | 10 | 20 | 441 | 6.88 |
| 65 | 15 | 20 | 485 | 6.98 |
| 60 | 20 | 20 | 569 | 7.07 |
| 55 | 25 | 20 | 566 | 7.20 |
| 50 | 30 | 20 | 660; 630 | 7.26; 7.57 |
| 70 | 5 | 25 | 466 | 6.86 |
| 65 | 10 | 25 | 543 | 6.95 |
| 55 | 20 | 25 | 552 | 7.16 |

Example 3

Continuous ribbons of several compositions of glassy alloys in the zirconium-copper-cobalt system were fabricated as in Example 1. Hardness values in kg/mm² (50 g load) and density in g/cm³ are listed in Table III below.

TABLE III

| Composition (Atom percent) | | | Hardness (kg/mm²) | Density (g/cm³) |
|---|---|---|---|---|
| Zr | Cu | Co | | |
| 60 | 5 | 35 | 563 | 7.38 |
| 55 | 5 | 40 | 677 | 7.76 |
| 65 | 10 | 25 | 496 | 7.15 |
| 60 | 10 | 30 | 522 | 7.05 |
| 60 | 15 | 25 | 540 | 7.22 |
| 55 | 15 | 30 | 613 | 7.39 |
| 55 | 20 | 25 | 641 | 7.33 |
| 65 | 25 | 10 | 485 | 7.04 |
| 60 | 25 | 15 | 543 | 7.22 |
| 55 | 25 | 20 | 549 | 7.30 |
| 50 | 25 | 25 | 585 | 7.50 |
| 60 | 35 | 5 | 540 | 7.19 |
| 55 | 35 | 10 | 554 | 7.33 |
| 45 | 35 | 20 | 666 | 7.40 |
| 40 | 35 | 25 | 666 | 7.77 |
| 50 | 45 | 5 | 600 | 7.41 |
| 45 | 45 | 10 | 677 | 7.16 |
| 35 | 45 | 20 | 692 | 7.80 |

TABLE III-continued

| Composition (Atom percent) | | | Hardness (kg/mm²) | Density (g/cm³) |
|---|---|---|---|---|
| Zr | Cu | Co | | |
| 40 | 55 | 5 | 689 | 7.63 |
| 35 | 55 | 10 | 677 | 7.78 |
| 35 | 60 | 5 | 670 | 7.80 |

Example 4

Continuous ribbons of several compositions of glassy alloys in the zirconium-copper-nickel system were fabricated as in Example 1. Hardness values in kg/mm² (50 g load) and density in g/cm³ are listed in Table IV below.

TABLE IV

| Composition (Atom percent) | | | Hardness (kg/mm²) | Density (g/cm³) |
|---|---|---|---|---|
| Zr | Cu | Ni | | |
| 70 | 25 | 5 | 449 | 6.97 |
| 60 | 35 | 5 | 509 | 7.10 |
| 45 | 50 | 5 | 603 | 7.48 |
| 35 | 60 | 5 | 681 | 7.73 |
| 75 | 15 | 10 | 468 | 6.88 |
| 55 | 35 | 10 | 594 | 7.24 |
| 50 | 40 | 10 | 596; 681 | 7.38; 7.49 |
| 45 | 45 | 10 | 637 | 7.50 |
| 40 | 50 | 10 | 648 | 7.60 |
| 35 | 55 | 10 | 670 | 7.77 |
| 70 | 15 | 15 | 460; 475 | 6.97 |
| 65 | 20 | 15 | 489 | 7.06 |
| 45 | 40 | 15 | 666 | 7.49 |
| 35 | 50 | 15 | 637 | 7.74 |
| 75 | 5 | 20 | 431 | 6.87 |
| 65 | 15 | 20 | 494; 575 | 7.03; 7.02 |
| 50 | 30 | 20 | 651 | 7.30 |
| 40 | 40 | 20 | 674 | 7.64 |
| 57.5 | 20 | 22.5 | 514 | 7.22 |
| 70 | 5 | 25 | 473 | 6.94 |
| 60 | 15 | 25 | 590 | 7.19 |
| 65 | 5 | 30 | 475 | 7.06 |
| 60 | 10 | 30 | 552 | 7.08 |
| 50 | 20 | 30 | 623 | 7.39 |
| 40 | 30 | 30 | 670 | 7.65 |
| 60 | 5 | 35 | 529 | 7.19 |
| 55 | 5 | 40 | 563 | 7.27 |
| 50 | 10 | 40 | 660 | 7.42 |
| 40 | 20 | 40 | 610 | 7.68 |

What is claimed is:

1. Substantially continuous filaments of a substantially glassy zirconium-copper alloy containing an element selected from the group consisting of cobalt and nickel, said alloy consisting essentially of a composition selected from the group consisting of:

(a) zirconium, copper and cobalt which, when plotted on a ternary composition diagram in atom percent Zr, atom percent Cu and atom percent Co, is represented by a polygon having at its corners the points defined by:
(1) 64 Zr - 35 Cu - 1 Co
(2) 31 Zr - 68 Cu - 1 Co
(3) 35 Zr - 35 Cu - 30 Co
(4) 56 Zr - 1 Cu - 43 Co
(5) 64 Zr - 1 Cu - 35 Co; and (b) zirconium, copper and nickel which, when plotted on a ternary composition diagram in atom percent Zr, atom percent Cu and atom percent Ni, is represented by a polygon having at its corners the points defined by:
(1) 64 Zr - 35 Cu - 1 Ni
(2) 31 Zr - 68 Cu - 1 Ni
(3) 40 Zr - 28 Cu - 32 Ni
(4) 57 Zr - 1 Cu - 42 Ni
(5) 71 Zr - 1 Cu - 28 Ni.

2. The filament of claim 1 in which the composition is defined by the area enclosed by the polygon a-b-c-d-e-a in FIG. 2 of the attached Drawing.

3. The filament of claim 1 in which the composition is defined by the area enclosed by the polygon a-b-c-d-e-a in FIG. 3 of the attached Drawing.

* * * * *